United States Patent [19]

Bashlow

[11] 3,968,521

[45] July 13, 1976

[54] COMBINED HEAD AND NECK WEAR

[76] Inventor: Joy Anne Bashlow, 54 Sherman St., Passaic, N.J. 07055

[22] Filed: Feb. 26, 1973

[21] Appl. No.: 335,646

[52] U.S. Cl. ..... 2/203

[51] Int. Cl.[2] ..... A42B 1/04

[58] Field of Search ..... 2/203, 202, 204, 205, 2/206, 207, 84, 171, 198, 221, 88, 219

[56] References Cited

UNITED STATES PATENTS

| | | | |
|---|---|---|---|
| 768,626 | 8/1904 | Rautenberg | 2/205 |
| 1,089,245 | 3/1914 | McLoughlin | 2/221 |
| 2,112,774 | 3/1938 | Thorman | 2/198 X |
| 2,443,085 | 6/1948 | Sachs | 2/221 |
| 3,144,660 | 8/1964 | Portaro | 2/88 |
| 3,505,678 | 4/1970 | Key | 2/207 X |
| 3,731,320 | 5/1973 | White et al. | 2/205 |
| R5,834 | 4/1874 | Pollard | 2/211 X |

FOREIGN PATENTS OR APPLICATIONS

| | | | |
|---|---|---|---|
| 2,171 | 2/1886 | United Kingdom | 2/202 |
| 556,306 | 9/1943 | United Kingdom | 2/84 |

*Primary Examiner*—Werner H. Schroeder
*Assistant Examiner*—Peter Nerbun

[57] ABSTRACT

Head-wear is provided made of a tubular configuration of textile material. The tube is tapered in the lengthwise direction and is configured to cover the front of the head, the ears, and the front of the neck and chest of the wearer. Complementary separable fastening means are attached to the narrow rim of the tube to permit adjustment and retention under the chin of the wearer. When the separable fastening means is secured, an overlap of material is effected which falls beneath the visible part of the front of the garment and is not visible.

9 Claims, 4 Drawing Figures

COMBINED HEAD AND NECK WEAR

SUMMARY OF THE INVENTION

This invention relates to a garment which is a combination hood and scarf having a novel cut and to a novel way for adapting such a garment to fit any wearer.

There is a need for a garment combining the characteristics of a hood for head protection and a scarf for protecting the neck. Currently in vogue is a lady's head covering generally called a "kerchief," a square of fabric, usually made of silk or silky material, which is folded along a diagonal, with the long ends tied beneath the chin of the wearer. Such a garment is not very elegant in appearance. Furthermore, it may easily slip out of place and fall off the head of the wearer. It provides only head covering.

(Some ladies wear a kerchief in combination with a separate scarf or a hat with a scarf.)

The instant scarf-hood is contoured to the head, neck, shoulders, and chest of the wearer and avoids certain of the disadvantages of the conventional long or short scarf.

There is also known and used at present a hood that is attached to a coat, such as shown in patent. This apparel is limited in application to a particular coat. It employs an opening at the front of the neck, and is not tightly fitted, so that the ears and head of the wearer may be exposed to cold air.

The scarf-hood provided herein is uniquely designed to enhance the beauty of the lady or girl who wears it, and its shape and simplicity of design account for established beauty principles.

Accordingly, a primary object of the instant invention is to provide a novel construction for a combined hood and scarf headdress.

Another object is to provide a new and improved lady's or girl's headdress which is tubular in shape and may be easily put on without upsetting a hairdo.

A further object is to provide a novel lady's headdress which protects both the head and neck of the wearer and is adjustable thereon, yet will be chic in appearance.

A still further object is to provide a novel lady's headdress which offers improvement in its ability to remain securely in position on the wearer's head.

These objects as well as other objects of this invention will become readily apparent by studying the following description of the accompanying drawings in which.

Figure 1:
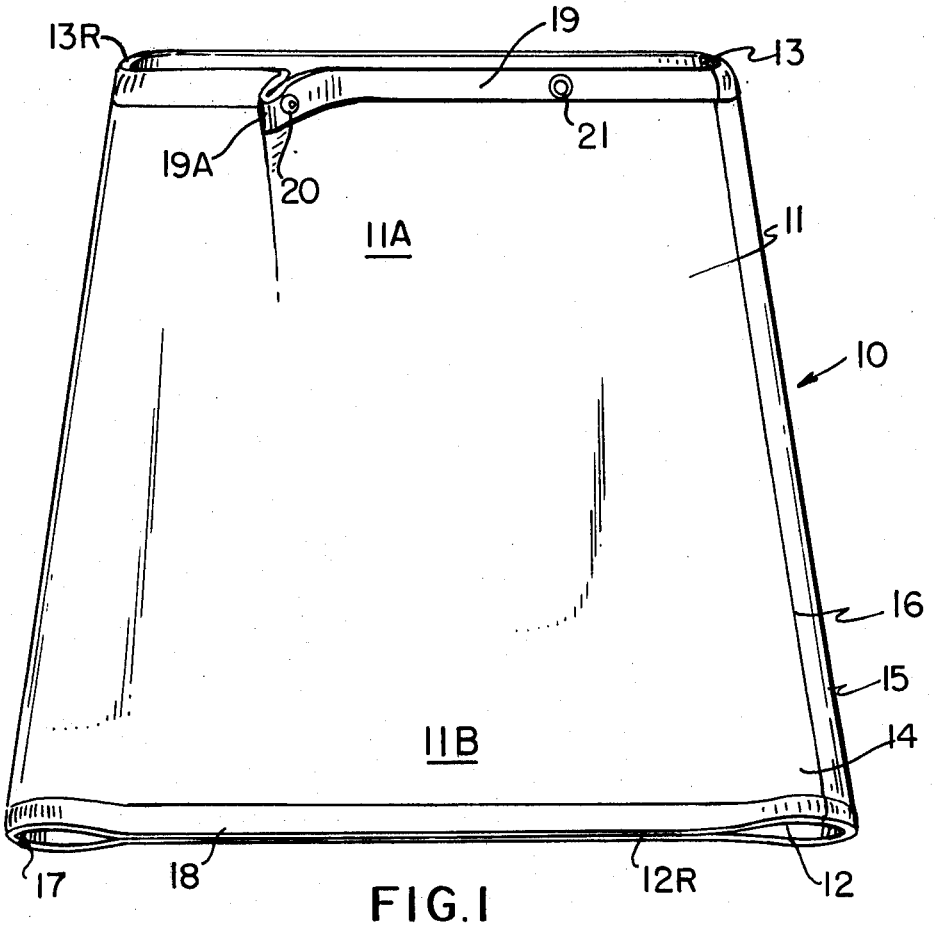
FIG. 1 is a plan view of a headdress and fastening means therefor, unfastened and with parts folded back to show the hems at the top and bottom.

Now referring to the figures and more particularly to FIG. 1, there is shown in FIG. 1 a wearing apparel 10, which may be referred to as a scarf-hood, that is made of textile material and is adapted to be worn over the head and shoulders as a headpiece and which also functions as a scarf that will protect and offer warmth for the wearer's head, neck, and shoulders. The apparel 10 is substantially a tube 11 of textile material, natural or synthetic, such as wool, which may be, for example, woven or knitted. The material is preferably tapered in shape, as shown, having an opening 12 at one end of greater diameter or extent than the opening 13 at the other end thereof. Notations 11A and 11B refer to upper and lower portions respectively of the tube 11. The apparel 10 is adapted to have its wider open end first slipped over the head of the wearer and carried down against and/or over the shoulders to cover and protect the major portion of the head, neck, and shoulders. Notations 14 and 15 refer to opposite walls of the tube 11 which are somewhat trapezoidal in shape when the tube 11 is made flat, while notations 16 and 17 refer to side seams of the tube along which the pieces from which the tube are formed are sewn together. The ends of the tubular formations are defined by rims 12R and 13R that are finished preferably by hemming, defining hems 18 and 19 formed therein by sewing.

Figure 2:
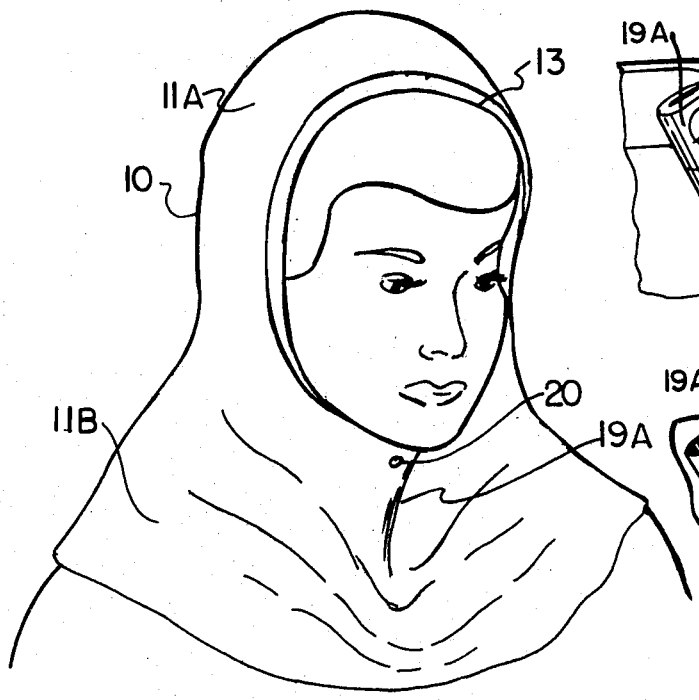
FIG. 2 shows the headdress on the head of a model, with the snap directly beneath the center of the chin.

FIG. 2 illustrates the apparel 10 disposed on the head of the wearer. The scarf-hood is shown extending over and closely against the head and neck, with the broader end 11B of the tube 11 extending along and around the shoulders so as to offer uninterrupted protection for the head, neck, and shoulders against the elements. A pair of snap fastener components 20 and 21, shown in FIG. 1, are fastened to respective portions of hem 19. In a preferred embodiment fastener component 20 is shown secured to opposed walls of a folded portion 19A of the upper hem 19. The folded portion 19A serves a number of important functional purposes, including providing an improved means for retaining the fastener component to the rim and serving to hide the fastener. It is noted, however, that the fastener may also be secured directly to an unfolded section of the hem. Fastener component 20 may be replaced by a button and the other fastener component 21 by a buttonhole formed in the hem.

When the fastener components 20 and 21 are in fastening relation, they draw the rim 13R tightly against the side of the head and under the chin, thus eliminating any spacing between the garment and the wearer so as to retain body heat and to properly secure the hood to the head and substantially close the loose opening afforded by the unfastened rim, the rim being made larger in circumference than the distance around the head crown, face, and chin of most persons, to accommodate users of different head sizes and shapes and to prevent spoilage of the wearer's hairdo.

While one pair of snap fastener components 20 and 21 is shown secured to the hem 19, which, when fastened, may suffice to accommodate most head sizes in a given range, a plurality of such fasteners may be disposed along opposed portions of the hem 19 for further adjustment, as may one or more buttons and accompanying buttonholes in the hem. Also a length of adjustable hooking fastener material may be provided; for example, strips of hook and loop fastening material such as Velcro, manufactured by American Velcro Corporation of New York, N.Y., may be sewn to opposite sides of the hem 19. Or "hook and eye" fasteners may be utilized.

Figure 3:
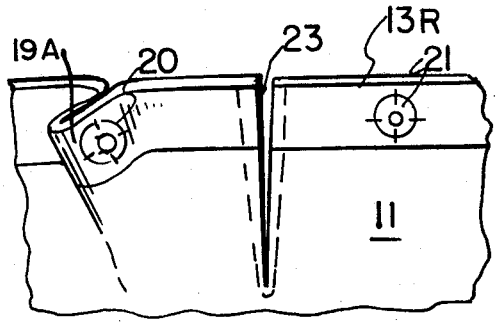
FIG. 3 shows an upper portion of the headdress of FIG. 1 with a longitudinal separation midway between the fastening means, in accordance with a first preferred embodiment.
Figure 4:
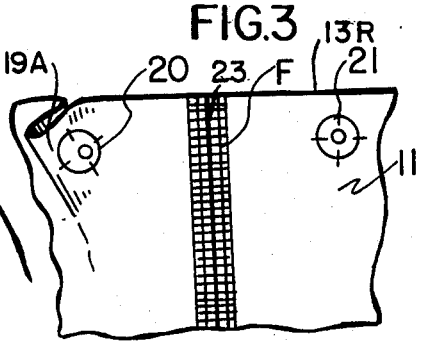
FIG. 4 shows an upper portion of the headdress of FIG. 1 with a zipper sewn along the longitudinal separation midway between the fastening means, in accordance with a second preferred embodiment.

Shown in FIG. 3 is a separation 23 which may optionally be provided extending a short distance from the rim 13R, along the edges of which separation components of a zipper fastener or other fastening means F may be provided to provide further opening to the tube to facilitate adjustment of the hood to more elaborate hairdos or wigs, as shown in FIG. 4.

The garment is put on by gathering up the garment in the hands, then the bottom, or wider diameter opening, fits over the head first and the top, or narrower diameter opening, fits and lies over the crown of the hair, with the snap lying beneath the chin. Without looking at what she is doing, the wearer can then snap the garment closed. The overlap will automatically fall beneath the garment, and if the wearer desires, she can place it off to a side underneath the neck portion with a slight manual adjustment. If she desires, she can move the snap portion to beneath an ear, in a preferred embodiment.

The wearing apparel shown in FIGS. 1 and 2 may be subject to a number of variations in shape and structure, certain of which are noted as follows:

a. Fastening means, such as a zipper, a series of snaps, or other means known in the art, may extend down the front of the garment from the bottom of the chin to the lower edge of the garment that ends above the torso of the wearer. A long slit may be cut into the garment for the purpose, and the overlap may or may not also be provided.

b. The described headpiece may be made of rectangular configuration without a tapered line. Such headgear could be comprised of two seams or, alternatively, one seam.

c. The described headpiece may be cut to define a shape extending down the back of the wearer, to provide the appearance of a conventional kerchief headpiece, by tapering the material downwardly narrower, terminating the seam above the lower end, and retaining the remaining material in a dangling attitude of single thickness material.

d. The portion of the scarf-hood which extends down the back of the wearer may also be otherwise shaped to vary the appearance thereof.

e. The hood may be made reversible, with one fabric on one side and another on the other side. In this embodiment two buttonholes adjacent each other are provided at a region near the narrower opening of the hood, the location of these buttonholes corresponding to the region where one of the snap fastener means would be placed in the preferred embodiment illustrated in the drawings herein. In this embodiment a button may be fastened in a location corresponding to the region where the complementary snap fastener is now placed in the embodiment illustrated in the drawings. Two buttons may also be provided, one behind the other, on respective sides of hood material. The buttons and buttonholes are spaced from each other in the same manner that the illustrated snap fasteners are spaced.

f. The hood may be cut in different sizes, i.e., it may fit right under the chin and end about there, or may be longer to end above the torso. It may also be cut to the waist to be a sweater-hood or jacket-hood, or it may be cut into a coat-hood. It may be fashioned into another useful garment with an attractive all-in-one look.

g. To upgrade the structure, padding may be provided at the crown section of the head, such padding comprising a square piece of cloth conforming to the head when the cloth is shirred. When this shirred piece of cloth is used beneath certain types of fabrics, the ruffles of the padding will not be visible to the viewer.

h. Elastic loops may be provided within the hem of the headdress which is underneath the part of the hood that surrounds the head and ears of the wearer, to promote the use of bobby pins, which may be inserted through these loops. The bobby pins will not be visible to the viewer, and the headdress is that much more secure on the head of the wearer.

As an alternative to the elastic loops, gaps in the sewing of the hem may be provided, so that there will be free pieces of material in the hem through which the lady can fasten her hairpins. The gaps may also be spaced in such a way as to accommodate clips, rather than bobby pins, which may be desired if the lady has extremely thick, heavy hair which is hard to fasten securely with a bobby pin.

i. Elastic may be sewn inside the hem at the top of the hood.

j. Instead of a slit in the overlap, fastening means may be employed the length of the overlap in the center of the overlap where the slit would be.

k. The entire hood may be cut wider, with an overlap extending the entire length of the garment, down the front of it, and fasteners hidden in the overlap.

l. The hood may be worn with the seams at the front and rear of the head instead of at the two sides.

Although there have been described preferred embodiments of this novel invention, many variations and modifications will now be apparent to those skilled in the art. Therefore, this invention is to be limited not by the specific disclosure herein but only by the appending claims.

The embodiments of the invention in which an exclusive privilege or property is claimed are defined as follows:

1. A protective garment for covering the head, neck, and shoulders of a wearer and for allowing the wearer's face to be exposed, and appropriate also for wearing in a fashion to cover only the shoulders and surround the neck and not cover the head, said protective garment comprising a truncated conically shaped sleeve of flexible material having a large diameter open end and a small diameter open end; said truncated conical sleeve having a trapezoidal cross-section at all cross-sections of said sleeve through both of its said open ends; said truncated conical sleeve having a length longer than the distance from just below the shoulder of a wearer to the top of the head of the wearer; said large diameter end having a periphery large enough to fit snugly around the shoulders of a wearer; said small diameter end having a periphery large enough to snugly receive the face of a wearer; said protective garment, when worn as a hood, having a plurality of randomly spaced folds along the lower edge, said folds constituting a draping.

2. The protective garment of claim 1 wherein said flexible material is a textile fabric type material.

3. A protective garment for covering the head, neck and shoulders of a wearer and for allowing the wearer's face to be exposed, and appropriate also for wearing in a fashion to cover only the shoulders and surround the neck and not cover the head, said protective garment comprising a truncated conically shaped sleeve of flexible material having a large diameter open end and a small diameter open end; said truncated conical sleeve having a trapezoidal cross-section at all cross-sections of said sleeve through both of its said open ends; said truncated conical sleeve having a length longer than the distance from just below the shoulder of a wearer to the top of the head of the wearer; said large diameter end having a periphery large enough to fit snugly around the shoulders of a wearer; said small diameter end having a periphery large enough to snugly receive the face of a wearer; said protective garment further including peripheral width adjustment means connected to said small diameter end of said sleeve to adjust the size of the opening formed in said small diameter end; said protective garment, when worn as a hood, having a plurality of randomly spaced folds along the lower edge, said folds constituting a draping.

4. Wearing apparel in accordance with claim 3 wherein said peripheral width adjustment means comprises at least one fastening means removably securable by the wearer.

5. Wearing apparel in accordance with claim 3 wherein said peripheral width adjustment means is disposed on the outer surface of said sleeve adjacent said small diameter end of said sleeve, whereby when said adjustment means reduces the size of said opening formed in said small diameter end the material of said sleeve is folded inwardly of said sleeve.

6. Wearing apparel in accordance with claim 3 wherein said peripheral width adjustment means comprises a plurality of snap fasteners having respective components secured to spaced apart locations on opposite sides of the rim adjacent said small diameter end of said sleeve.

7. Wearing apparel in accordance with claim 3 wherein said sleeve is made of two cuttings of textile material sewn together along opposite side edges thereof.

8. Wearing apparel in accordance with claim 3 wherein both open ends of said sleeve are defined by respective hemming of the flexible material.

9. Wearing apparel in accordance with claim 3 wherein said peripheral width adjustment means includes a first fastening means, means for securing said first fastening means to a first folded portion of the rim defining said smaller opening in said sleeve and wherein said fastener securing means holds said portion of said rim together, and second fastening means secured to said rim a distance away from said folded portion and operable to engage and retain said first fastening means to provide a second fold in said rim between the two fastening means to take up the slack and secure said rim against the face of the user.

* * * * *